US011756510B2

(12) United States Patent
Nicholson et al.

(10) Patent No.: US 11,756,510 B2
(45) Date of Patent: Sep. 12, 2023

(54) SYSTEMS, DEVICES, AND METHODS FOR ASSEMBLING IMAGE DATA FOR DISPLAY

(71) Applicant: GOOGLE LLC, Mountain View, CA (US)

(72) Inventors: Stuart James Myron Nicholson, Waterloo (CA); Isaac James Deroche, Kitchener (CA); Jerrold Richard Randell, Waterloo (CA); Lai Pong Wong, Waterloo (CA); Chris Brown, Kitchener (CA)

(73) Assignee: GOOGLE LLC, Mountain View, CA (US)

( * ) Notice: Subject to any disclaimer, the term of this patent is extended or adjusted under 35 U.S.C. 154(b) by 0 days.

(21) Appl. No.: 17/344,394

(22) Filed: Jun. 10, 2021

(65) Prior Publication Data

US 2022/0270571 A1 Aug. 25, 2022

Related U.S. Application Data

(60) Provisional application No. 63/037,082, filed on Jun. 10, 2020.

(51) Int. Cl.
*G09G 5/393* (2006.01)

(52) U.S. Cl.
CPC ..... *G09G 5/393* (2013.01); *G09G 2330/021* (2013.01); *G09G 2340/145* (2013.01); *G09G 2352/00* (2013.01); *G09G 2360/128* (2013.01)

(58) Field of Classification Search
CPC ..... G09G 5/393; G09G 2320/02; G09G 2320/04; G09G 2320/00; G09G 2320/10; G09G 2330/021; G09G 2340/00; G09G 2340/145; G09G 2360/128; G06T 3/4007
See application file for complete search history.

(56) References Cited

U.S. PATENT DOCUMENTS 5,847,714 A * 12/1998 Naqvi ..... H04N 1/3935 348/561
2007/0058857 A1* 3/2007 Chi ..... G06T 3/4015 382/162
2010/0202713 A1* 8/2010 Rosasco ..... H04N 19/40 382/302
2019/0392556 A1* 12/2019 Zhao ..... G06T 3/4007
2020/0073119 A1* 3/2020 Urquhart ..... G06F 3/013

* cited by examiner

*Primary Examiner* — Hau H Nguyen

(57) ABSTRACT

Systems, devices, and methods for generating, processing, assembling, and/or formatting data for display are described. Example display controllers are described in which image data is stored in a framebuffer, and a compositor selectively retrieves portions of the image data. At least one P-operator produces lines of intermediate P-operated data by performing at least one intra-line operation on the image data retrieved by the compositor, such as repeating or reordering pixels of the image data. A Q-operator produces a stream of pixel data by performing inter-line operations on the intermediate P-operated data, such as interpolating between lines of the P-operated data. A display is driven according to the stream of pixel data.

20 Claims, 10 Drawing Sheets

SYSTEMS, DEVICES, AND METHODS FOR ASSEMBLING IMAGE DATA FOR DISPLAY

CROSS-REFERENCE TO RELATED APPLICATIONS

The present application claims priority to U.S. Provisional Patent Application Ser. No. 63/037,082, entitled "SYSTEMS, DEVICES, AND METHODS FOR ASSEMBLING IMAGE DATA FOR DISPLAY" and filed on Jun. 10, 2020, the entirety of which is incorporated by reference herein.

BACKGROUND

Advancements in integrated circuit technology have enabled the development of electronic devices that are sufficiently small and lightweight to be carried by the user. Such "portable" electronic devices may include on-board power supplies (such as batteries or other power storage systems) and may be "wireless" (i.e., designed to operate without any wire-connections to other, non-portable electronic systems); however, a small and lightweight electronic device may still be considered portable even if it includes a wire-connection to a non-portable electronic system. For example, a microphone may be considered a portable electronic device whether it is operated wirelessly or through a wire-connection.

The convenience afforded by the portability of electronic devices has fostered a huge industry. Smartphones, audio players, laptop computers, tablet computers, and e-book readers are all examples of portable electronic devices. However, the convenience of being able to carry a portable electronic device has also introduced the inconvenience of having one's hand(s) encumbered by the device itself. This problem is addressed by making an electronic device not only portable, but wearable.

A wearable electronic device is any portable electronic device that a user can carry without physically grasping, clutching, or otherwise holding onto the device with their hands. For example, a wearable electronic device may be attached or coupled to the user by a strap or straps, a band or bands, a clip or clips, an adhesive, a pin and clasp, an article of clothing, tension or elastic support, an interference fit, an ergonomic form, etc. Examples of wearable electronic devices include digital wristwatches, electronic armbands, electronic rings, electronic ankle-bracelets or "anklets," head-mounted electronic display units, hearing aids, and so on.

Because they are worn on the body of the user, and typically visible to others, and generally present for long periods of time, form factor (i.e., size, geometry, and appearance) is a major design consideration in wearable electronic devices.

Electronic devices, including portable electronic devices, wearable electronic devices, as well as non-portable or non-wearable electronic devices, can include displays and display components. As non-limiting examples, such display components can include light sources, display light redirection optics, screens, driver circuitry, and display data storage (e.g. framebuffers). Display components occupy space and consume power. In portable electronic devices, this may result in the electronic device being large, heavy, and/or bulky, including a large battery, which reduces portability. Even in non-portable electronic devices, it is preferable for components of the device to be small and low power, to minimize space occupied by the electronic device as well as power consumption and power costs. Thus, it is generally desirable to minimize the size and power consumption of display related components in electronic devices.

Wearable devices can include head-mounted devices, which are devices to be worn on a user's head when in use. A head-mounted display is an electronic device that is worn on a user's head and, when so worn, secures at least one electronic display within a viewable field of at least one of the user's eyes. A wearable heads-up display (WHUD) is a head-mounted display that enables the user to see displayed content but that also enables the user to see their external environment. The "display" component of a wearable heads-up display is typically either transparent or at a periphery of the user's field of view so that it does not completely block the user from being able to see their external environment. Examples of wearable heads-up displays include: the Google Glass®, the Optinvent Ora®, the Epson Moverio®, and the Microsoft Hololens® just to name a few.

BRIEF SUMMARY OF EMBODIMENTS

In one example embodiment, a display controller may include a framebuffer to store image data; a compositor to selectively retrieve at least one portion of image data from the framebuffer; a first P-operator to receive the at least one portion of image data, and to produce intermediate data by performing at least one intra-line operation on the at least one portion of image data; a Q-operator to receive the intermediate data, and to produce a stream of pixel data for driving a display by performing at least one inter-line operation on the intermediate data.

The display controller may further include a second P-operator, a first linebuffer, and a second linebuffer. The compositor may selectively retrieve a first line of image data from the framebuffer; the first linebuffer may receive and store the first line of image data; the compositor may selectively retrieve a second line of image data from the framebuffer; the second linebuffer may receive and store the second line of image data; the first P-operator may retrieve the first line of image data from the first linebuffer, and may produce first intermediate data by performing at least one intra-line operation on the first line of image data; the second P-operator may retrieve the second line of image data from the second linebuffer, and may produce second intermediate data by performing at least one intra-line operation on the second line of image data; and the Q-operator may receive the first intermediate data and the second intermediate data, and may produce a stream of pixel data for driving a display by performing at least one inter-line operation on the first intermediate data and the second intermediate data.

The at least one intra-line operation performed by the first P-operator may include selecting a limited portion of the image data for inclusion in the intermediate data.

The at least one intra-line operation performed by the first P-operator may include repeating selected pixels of the image data in the intermediate data.

The at least one intra-line operation performed by the first P-operator may include selectively reordering pixels of the image data in the intermediate data.

The at least one inter-line operation performed by the Q-operator may include selecting a limited portion of the intermediate data for inclusion in the stream of pixel data for driving the display.

The at least one inter-line operation performed by the Q-operator may include interpolating between at least two lines of the intermediate data.

The display controller may further include a laser diode driver to receive the stream of pixel data and drive at least one laser diode according to the stream of pixel data.

The display controller may include an integrated circuit, and the compositor, P-operator, and Q-operator are logical components of the integrated circuit.

The display controller may further include a non-transitory processor-readable storage medium having instructions recorded thereon that, when executed, control operation of the compositor, first P-operator, and Q-operator.

According to another example embodiment, a method of controlling a display by a display controller may include selectively retrieving, by a compositor, at least one portion of image data from a framebuffer; receiving, by a first P-operator, the at least one portion of image data retrieved by the compositor; producing intermediate data by performing, by the first P-operator, at least one intra-line operation on the at least one portion of image data retrieved by the compositor; receiving, by a Q-operator, the intermediate data; producing a stream of pixel data for driving the display by performing, by the Q-operator, at least one inter-line operation on the intermediate data.

Selectively retrieving, by the compositor, at least one portion of image data from the framebuffer may include selectively retrieving, by the compositor, a first line of image data from the framebuffer; and selectively retrieving, by the compositor, a second line of image data from the framebuffer. The method may further include storing, by a first linebuffer, the first line of image data; and storing, by a second linebuffer, the second line of image data; retrieving, by a second P-operator, the second line of image data from the second linebuffer; and producing second intermediate data by performing, by the second P-operator, at least one intra-line operation on the second line of image data. Receiving, by the first P-operator, the at least one portion of image data retrieved by the compositor may include retrieving, by the first P-operator, the first line of image data from the first linebuffer; producing intermediate data may include producing first intermediate data by performing, by the first P-operator, at least one intra-line operation on the first line of image data; producing a stream of pixel data for driving the display may include performing, by the Q-operator, at least one inter-line operation on the first intermediate data and the second intermediate data.

Performing the at least one intra-line operation by the first P-operator may include selecting a limited portion of the image data for inclusion in the intermediate data.

Performing the at least one intra-line operation by the first P-operator may include repeating selected pixels of the image data in the intermediate data.

Performing the at least one intra-line operation by the first P-operator may include selectively reordering pixels of the image data in the intermediate data.

Performing the at least one inter-line operation by the Q-operator may include selecting a limited portion of the intermediate data for inclusion in the stream of pixel data for driving the display.

Performing the at least one inter-line operation by the Q-operator may include interpolating between at least two lines of the intermediate data.

The method may further include receiving the stream of pixel data by a laser diode driver; and driving, by the laser diode driver, at least one laser diode according to the stream of pixel data.

According to another example embodiment, a wearable heads-up display (WHUD) may include a support structure to be worn on head of a user; a display carried by the support structure; a render engine carried by the support structure, the render engine to render image data for display; and a display controller. The display controller may include a framebuffer to receive and store image data from the render engine; a compositor to selectively retrieve at least one portion of image data from the framebuffer; a first P-operator to receive the at least one portion of image data retrieved by the compositor, and to produce intermediate data by performing at least one intra-line operation on the at least one portion of image data; and a Q-operator to receive the intermediate data and to produce a stream of pixel data by performing at least one inter-line operation on the intermediate data, such that the display may be driven according to the stream of pixel data.

The display controller may further include a second P-operator, a first linebuffer, and a second linebuffer. The compositor may selectively retrieve a first line of image data from the framebuffer; the first linebuffer may receive and store the first line of image data; the compositor may selectively retrieve a second line of image data from the framebuffer; the second linebuffer may receive and store the second line of image data; the first P-operator may retrieve the first line of image data from the first linebuffer, and may produce first intermediate data by performing at least one intra-line operation on the first line of image data; the second P-operator may retrieve the second line of image data from the second linebuffer, and may produce second intermediate data by performing at least one intra-line operation on the second line of image data; and the Q-operator may receive the first intermediate data and the second intermediate data, and may produce the stream of pixel data by performing at least one inter-line operation on the first intermediate data and the second intermediate data.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements are arbitrarily enlarged and positioned to improve drawing legibility. Further, the particular shapes of the elements as drawn are not necessarily intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with portable electronic devices and head-worn devices, have not been shown or described in detail to avoid unnecessarily obscuring descriptions of the embodiments.

Reference throughout this specification to "one embodiment" or "an embodiment" means that a particular feature, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The headings and Abstract of the Disclosure provided herein are for convenience only and do not interpret the scope or meaning of the embodiments.

The various embodiments described herein provide systems, devices, and methods for controlling and managing display data presented by a display.

Figure 1:
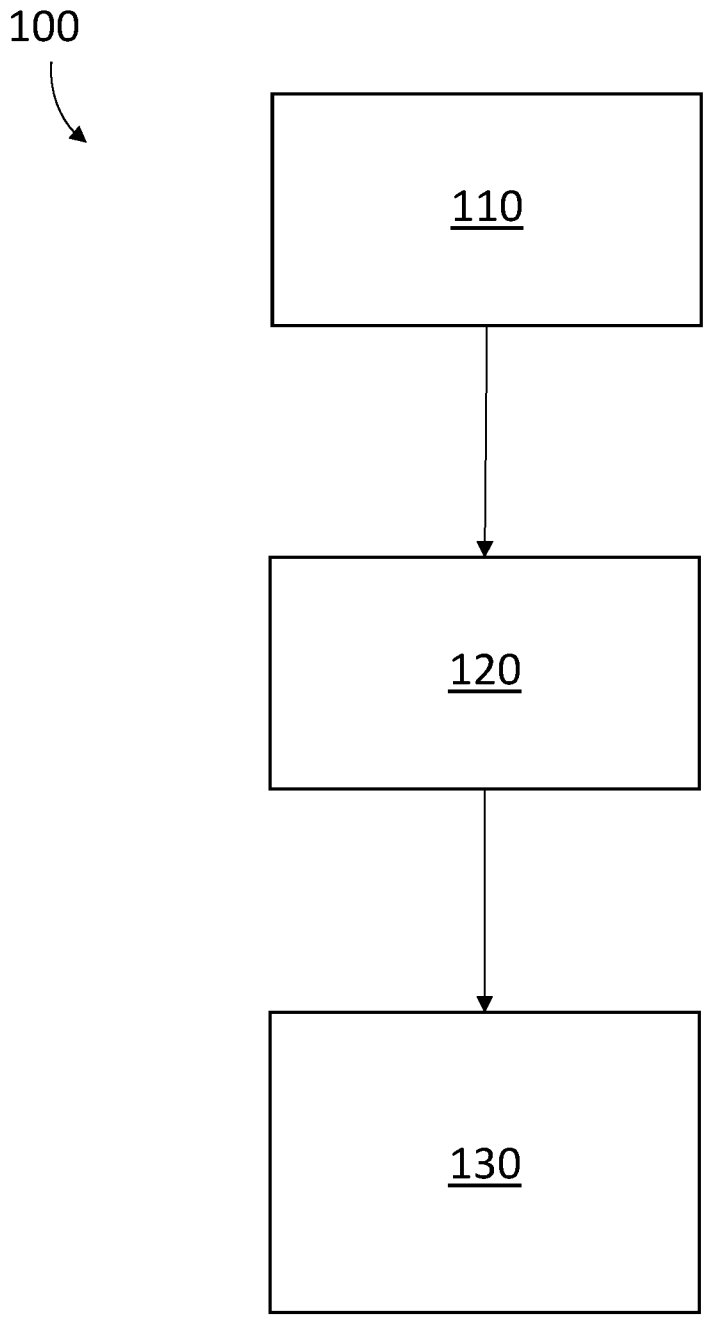
FIG. 1 is a schematic diagram of a system for displaying content in accordance with one or more embodiments.

FIG. 1 is a schematic diagram of an example system 100. System 100 includes a render engine 110, a display controller 120, and a display 130. Render engine 110 can render content to be displayed by display 130. As non-limiting examples, each of render engine 110 and display controller 120 may include a micro-controller, microprocessor, multicore processor, integrated-circuit, ASIC, FPGA, programmable logic device, processing circuitry, or any appropriate combination of these components. In certain embodiments, one or both of render engine 110 and display controller 120 may be operated by executing instructions stored on at least one non-transitory processor readable medium. Such a non-transitory controller-readable storage mediums may include any suitable component which can store instructions, logic, or programs, including but not limited to non-volatile or volatile memory, read only memory (ROM), random access memory (RAM), FLASH memory, registers, magnetic hard disk, optical disk, or any combination of these components.

In an example embodiment, render engine 110 may include at least one general purpose processor, which can execute instructions stored on at least one non-transitory processor-readable storage medium to render content for display. Display controller 120 may include an integrated circuit. As a non-limiting example use-case, the at least one processor (render engine 110) may run an application from the at least one non-transitory processor-readable storage medium, and may render user interface elements together for display, and provide rendered data to display controller 120, which can control display 130 based on the rendered data.

Render engine 110 can render an image frame for display, and provide image data representing the rendered image frame to display controller 120. Display controller 120 can format the image data to a format appropriate for display 130, and can drive display 130 according to the formatted frame data. In an example embodiment, display 130 can include at least one light engine and driver circuitry, such that display controller 120 formats the frame data to a format acceptable to the driver circuitry. In another example embodiment, the driver circuitry can be part of display controller 120, such that display controller 120 drives at least one light engine in display 130. Non-limiting examples of light engines may include at least one laser, LED, microdisplay, scanning laser projector, or any other appropriate light sources which can generate display light.

Display light from at least one light engine in display 130 can be redirected by a light redirection optic to form a display visible to a user of system 100. Such a light redirection optic may include a holographic optical element, a lightguide combiner, and LCD screen, a prism, or other appropriate optical component.

In certain embodiments, the system of FIG. 1 can be considered "flow-through" in the sense that, for each image frame displayed, the render engine 110 renders the image frame and provides image data to the display controller 120, the display controller 120 formats the image data, and the display 130 is driven according to the formatted image data to display the image frame to the user. That is, data for each image frame flows from the render engine 110, to the display controller 120, to the display 130. Consequently, as long as the system 100 is powered on and presenting a display to the user, all of the render engine 110, the display controller 120, and the display 130 are active and consuming power. For some applications, such as presentation of user interfaces, the content to be displayed may not change every frame. Consequently, rendering each frame by render engine 110 may involve rendering the same image data multiple times, which is redundant and consumes excessive power. It is desirable to limit activity of the render engine 110 to reduce power consumption.

Figure 2:
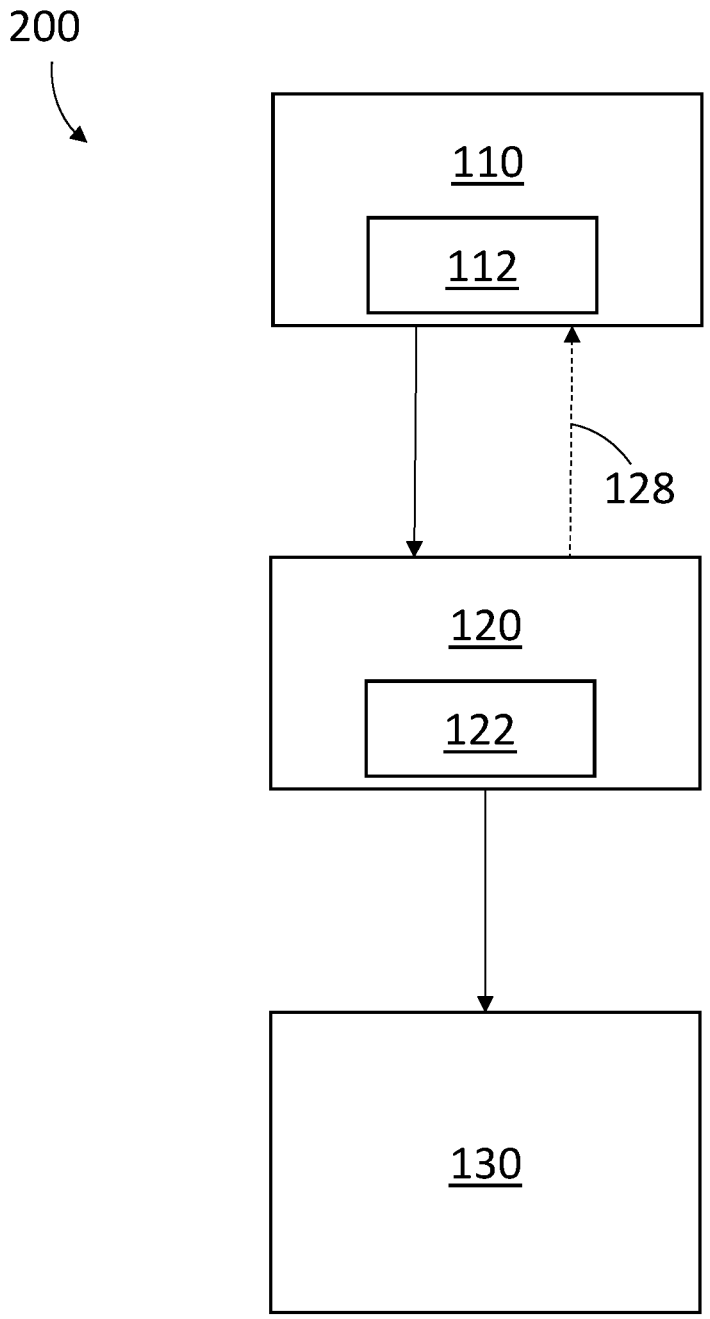
FIG. 2 is a schematic diagram of a system which includes additional components compared to those illustrated in FIG. 1, in accordance with one or more embodiments.

FIG. 2 is a schematic diagram of an example system 200 in accordance with one embodiment of the present disclosure which can reduce power consumption by reducing activity of render engine 110. System 200 in FIG. 2 is similar in at least some respects to system 100 in FIG. 1, and description of components in FIG. 1 is applicable to similarly numbered components in FIG. 2 unless context dictates otherwise.

One difference between system 200 and system 100 is that in system 200, display controller 120 includes a framebuffer 122. In certain embodiments, framebuffer 122 may comprise a non-transitory processor-readable medium, and can store data for an image frame thereon, such that when the content to be displayed does not change between frames, display 130 can be driven according to the image data stored in framebuffer 122. In this way, the display controller 120 can be said to "self-refresh," in that the render engine 110 does not need to provide new image data to the display controller 120. Thus, power consumed by redundant rendering operations is reduced. In some embodiments, render engine 110 may even be powered off when display controller 120 is self-refreshing.

"Self-refresh" can be useful in a number of scenarios. As one example, sometimes a single frame may be displayed on loop for multiple frame cycles, such as when a user is looking at an interface screen without change, such as when a user is reading content on the screen. Additionally, "self-refresh" can be useful not only for repeatedly displaying an image frame when the content is not changing, but also for maintaining a high display frame rate without requiring image data to be rendered at the high frame rate. For example, render engine 110 may render every second image frame, and display controller 120 may "self-refresh" and display every rendered image frame twice. In this way render engine 110 may have a relatively low frame rendering rate, but display 130 may still output frames at a higher rate to maintain display continuity and reduce effects like flicker.

Preferably, framebuffer 122 should be large enough to store data representing a complete image frame. In some embodiments, framebuffer 122 should be large enough to store data representing two full image frames. In this way, one frame can be read for display from framebuffer 122 while another frame is being written to framebuffer 122. However, framebuffer 122 is hardware which occupies space and consumes power. For example, framebuffer 122 may be SRAM (static random access memory) or DRAM (dynamic random access memory). SRAM advantageously has low power consumption, but occupies significant physical volume compared to the amount of data which can be stored therein. On the other hand, DRAM advantageously can store more data in less physical volume than SRAM, but DRAM utilizes regular refreshing and consequently consumes more power than SRAM. As discussed above, it is desirable for a portable electronic device to be as small and as power efficient as possible. Therefore, it is desirable to achieve a framebuffer 122 which provides a balance of small physical volume, low power consumption, and enough storage space to store two image frames of data. One way to achieve this is by utilizing compression to reduce the utilized storage space of framebuffer 122.

Another difference between system 200 and system 100 is that in system 200, a dashed line 128 is shown from display controller 120 to render engine 110, representing feedback from display controller 120 to render engine 110. This dashed line 128 can represent a dedicated physical feedback connection such as a wire, trace, or pins. Alternatively, dashed line 128 may represent the modulation of a feedback signal or signals over an existing physical connection, such as the tear effect (TE) pin. The feedback signal may include timing and/or status information from display controller 120 to render engine 110.

Yet another difference between system 200 and system 100 is that in system 200, render engine 110 is shown as including a framebuffer 112. Alternatively, render engine 110 may be communicatively coupled to frame buffer 112 as separate hardware. In embodiments which include framebuffer 112, after rendering an image frame, render engine 110 can provide image data representing the rendered image frame to framebuffer 112, which can subsequently be retrieved by display controller 120. Alternatively, in embodiments which do not include framebuffer 112, the rendered frame can be streamed to display controller 120.

Detailed discussion of framebuffer management, compression, flow-through modes, and self-refresh modes of display systems are discussed in detail in U.S. Provisional Patent Application No. 63/013,101.

Figure 3:
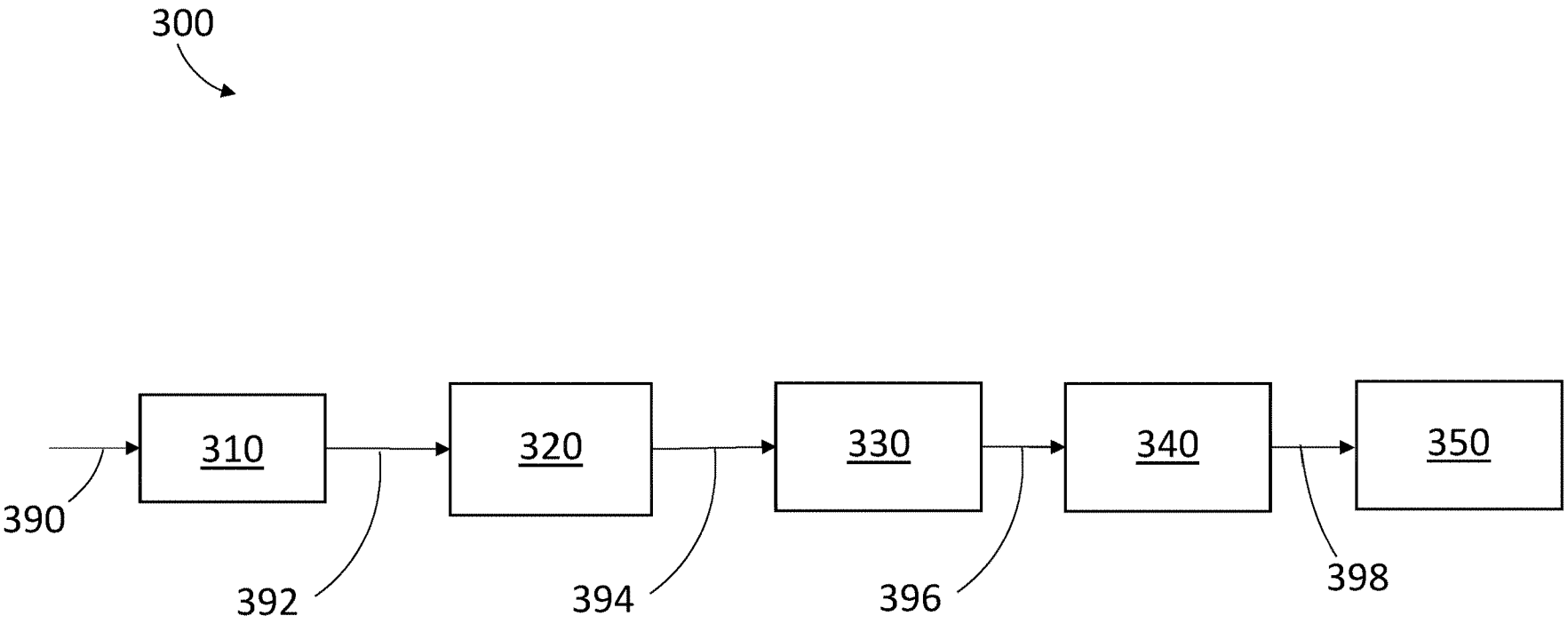
FIG. 3 is a schematic diagram of a display controller, in accordance with one or more embodiments.

FIG. 3 is a schematic view of an example display controller 300, which can be similar and serve a similar role as display controller 120 discussed above. Display controller 300 can include at least a framebuffer 310, compositor 320, P-operator 330, and Q-operator 340. As used herein, the terms "P-operator" and "Q-operator" are labels for logical components, and are not limited to any specific hardware embodiment of said logical components. As one example, a display controller which includes at least one "P-operator" or "Q-operator" may be an integrated circuit, and the at least one "P-operator" or "Q-operator" may be a portion of the integrated circuit. As another example, any "P-operator" or "Q-operator" may be a separate physical component, such as an integrated circuit, FPGA, or programmable logic controller. Further, in various embodiments, any "P-operator" or "Q-operator" may be a statically controlled component or a dynamically controlled component. In dynamic control, any "P-operator" or "Q-operator" can be controlled during operation by instructions, such as those provided by a map generator or retrieved from memory. In static control, any "P-operator" or "Q-operator" may be designed, constructed, or implemented to operate in a pre-determined way to perform P-operations or Q-operations, without utilizing such instructions during operation. Generally, P-operations may be considered as intra-line operations on data (typically in a direction termed the P direction), performed by a P-operator and resulting in "P-operated" intermediate data. Similarly, Q-operations may be considered as inter-line operations on data (typically in a direction termed the Q direction), performed by a Q-operator and resulting in "Q-operated" data.

FIG. 3 also includes a laser diode driver (LDD) 350, which may, in various embodiments, be part of display controller 300 or may be a separate component from display controller 300. Display controller 300 may be an integrated circuit, such that one or more of these components may be built into the integrated circuit. Alternatively, display controller 300 may be a micro-controller, microprocessor, multi-core processor, integrated-circuit, FPGA, programmable logic device, processing circuitry, or any appropriate combination of these components. In display controller 300, and any of the other display controllers discussed herein, the various components can be communicatively coupled by electrically conductive pathways, such as wires, conductive traces, vias, conductive layers, or any other appropriate couplings.

In the context of display controllers discussed herein, input image data to a display controller is referenced by (U, V) coordinates, data within a display controller processor stream is referenced by (p, q) coordinates, and image data output by a display is referenced by (x, y) coordinates. For example, with reference to FIG. 3, a render engine renders image data 390, and provides image data 390 to framebuffer 310 for storage. Image data 390 can be considered input image data to display controller 300, and is referenced with (U, V) coordinates. Display controller 300 will drive a display according to image data 398 output at the end of the image processing stream. This image data 398 is referenced with (p, q) coordinates. A display driven according to image data 398 will output an image which is referenced by (x, y) coordinates.

The depicted embodiment of FIG. 3 further includes framebuffer 310, which can be similar to framebuffer 122 discussed above such that the description of framebuffer 122 may generally be applied to framebuffer 310. In summary, framebuffer 310 can store at least one image frame (or in some cases a partial image frame) to be processed by display controller 300 for display.

Compositor 320 can selectively retrieve a portion, portions, or an entirety of an image frame stored in framebuffer 310, according to what is to be displayed (shown as image data 392 in FIG. 3). In some scenarios, input image data 390 may represent an entire displayable area, but it may be desirable to output display light over only a portion of the displayable area. As an example, a user interface may be displayed in only a portion or portions of a displayable area, such as a center region, a bottom region, a top region, a left region, and/or a right region. When retrieving image data from framebuffer 310, compositor 320 may selectively retrieve only image data for desired display regions. As another example, in displays where multiple copies of an image can be displayed, such as to produce multiple exit pupils, compositor 320 may retrieve image data from framebuffer 310 only for desired exit pupil regions. As another example, in systems which include scanning laser projector (SLP) based displays, image data may include different portions for projection according to a projection pattern of the scanning laser projector; compositor 320 may retrieve portions of the image data which correspond to the projection pattern of the scanning laser projector. Non-limiting examples of image data having different portions for projection according to a scan pattern of the scanning laser projector are discussed in U.S. Provisional Patent Application No. 62/863,935.

In certain embodiments, the portions of image data to be selectively retrieved by compositor 320 may be indicated by a compositor map, which instructs compositor 320 which regions to retrieve. Such a compositor map may be based on eye tracking data, user interface data, or any other appropriate data which is indicative of relevant areas of a display for display.

By storing image data 390 in framebuffer 310, and compositor 320 selectively retrieving portions of image data (image data 392) from framebuffer 310, different display parameters may be satisfied on a per-frame basis. In scenarios where an image frame is to be displayed more than once, the display may be driven according to the image data already stored in framebuffer 310, but compositor 320 may select different regions of data to be retrieved. For example, if an eye-tracking system detects a change in gaze direction of the user between display of a first image frame and a second image frame, compositor 320 may retrieve portions of image data corresponding to exit pupil(s) for the second frame which are different from portions of image data retrieved corresponding to exit pupil(s) for the first frame, even if the overall image data has not changed. As another example, in systems which include scanning laser projector based displays, a projection pattern of the scanning laser projector may change each frame; compositor 320 may retrieve portions of the image data which correspond to a first projection pattern for display of a first image frame, and compositor 320 may retrieve portions of the image data which correspond to a second projection pattern for display of a second frame.

Additionally, in order for image data 390 to fit in framebuffer 310, image data 390 may be compressed. When compositor 320 retrieves portions of image data from framebuffer 310, compositor 320 can decompress the retrieved image data.

Image data retrieved by compositor 320 can be provided to P-operator 330 (shown as image data 394 in FIG. 3). This provision may entail compositor 320 storing retrieved image data in at least one linebuffer, and P-operator 330 retrieving image data from the linebuffer, as discussed in more detail below with reference to FIGS. 5 and 6. P-operator 330 performs intra-line operations on image data to be displayed, that is, operations within a line in the "p" dimension.

As one example, P-operator 330 may selectively reorder pixels of image data in a line. For example, P-operator 330 may determine a display direction of a line, and arrange or reorder image data representing the line in the determined direction for display. This can be particularly valuable in systems which include an SLP based display. In SLP based displays, at least one scan mirror of the SLP can oscillate back and forth to redirect display light from at least one laser diode over a display area. This oscillation results in the scan direction reversing for each line. P-operator 330 can account for this, by reversing the direction of alternate lines in the image data retrieved by compositor 320.

As another example, P-operator 330 may compensate for non-linear movement speed of an oscillating mirror in an SLP based display, by repeating selected pixels of the image data 394 from compositor 320. This concept is discussed in detail later with reference to FIGS. 9 and 10A-10C.

Image data output by P-operator 330 can be referred to as "P-operated" data 396, meaning that at least one intra-line operation has been performed on the image data. Intermediate P-operated data 396 can be received by Q-operator 340. Q-operator 340 performs inter-line operations on image data to be displayed, that is, operations in the "q" dimension between lines of P-operated data output by the P-operator.

In certain embodiments and scenarios, Q-operator 340 can interpolate image data between lines of P-operated data. For example, Q-operator 340 may interpolate additional image data to fill in between lines of intermediate P-operated data 396, such as to increase smoothness of a projected image without requiring additional image data be stored in framebuffer 310. As another example, Q-operator 340 may interpolate image data between lines of intermediate P-operated data to provide image data which more closely matches a projection pattern in systems which use SLP-based displays. In particular, a projection pattern for an SLP may have a zig-zag shape which may not exactly match pixels of an image arranged in a square grid pattern. In this and other scenarios, Q-operator 340 can interpolate between lines of the image data to provide image data which matches or more closely approximates the zig-zag shape of the projection pattern for at least some regions of the image data. This concept is discussed in detail in U.S. Provisional Patent Application No. 62/863,935.

Q-operator 340 can output image data 398. Display 130 can be driven according to image data 398 output by Q-operator 340. For example, in systems which include an SLP based display, image data 398 can be a stream of pixel data which is provided to laser diode driver (LDD) 350. In the example of FIG. 3, LDD 350 is illustrated as being included in display controller 300. For example, display controller 300 may be an integrated circuit which includes the LDD 350. However, in alternative embodiments LDD 350 may be separate from display controller 300. For example, display controller 300 may be an integrated circuit, and the LDD 350 may be a separate integrated circuit. LDD 350 can receive image data 398 as a stream of pixel data, and convert the stream of pixel data to a series of voltage pulses which drive at least one laser diode, producing a series of pulses of laser light. When timed with at least one scanning mirror (such as by a timing circuit), these pulses of laser light form a projected image.

Display controller 300 as shown in FIG. 3 can be used to display a single color channel or multiple color channels of an image. For example, input image data 390 may include data for multiple color channels (e.g., red "R", green "G", and blue "B", though other colors and quantities of channels are possible). Each of compositor 320, P-operator 330, and Q-operator 340 can perform processing on each of the color channels, to provide image data to respective LDDs of LDD 350 to drive respective laser diodes corresponding to each color channel. However, it is possible to include a separate component stream for different color channels as discussed below with reference to FIG. 4.

Figure 4:
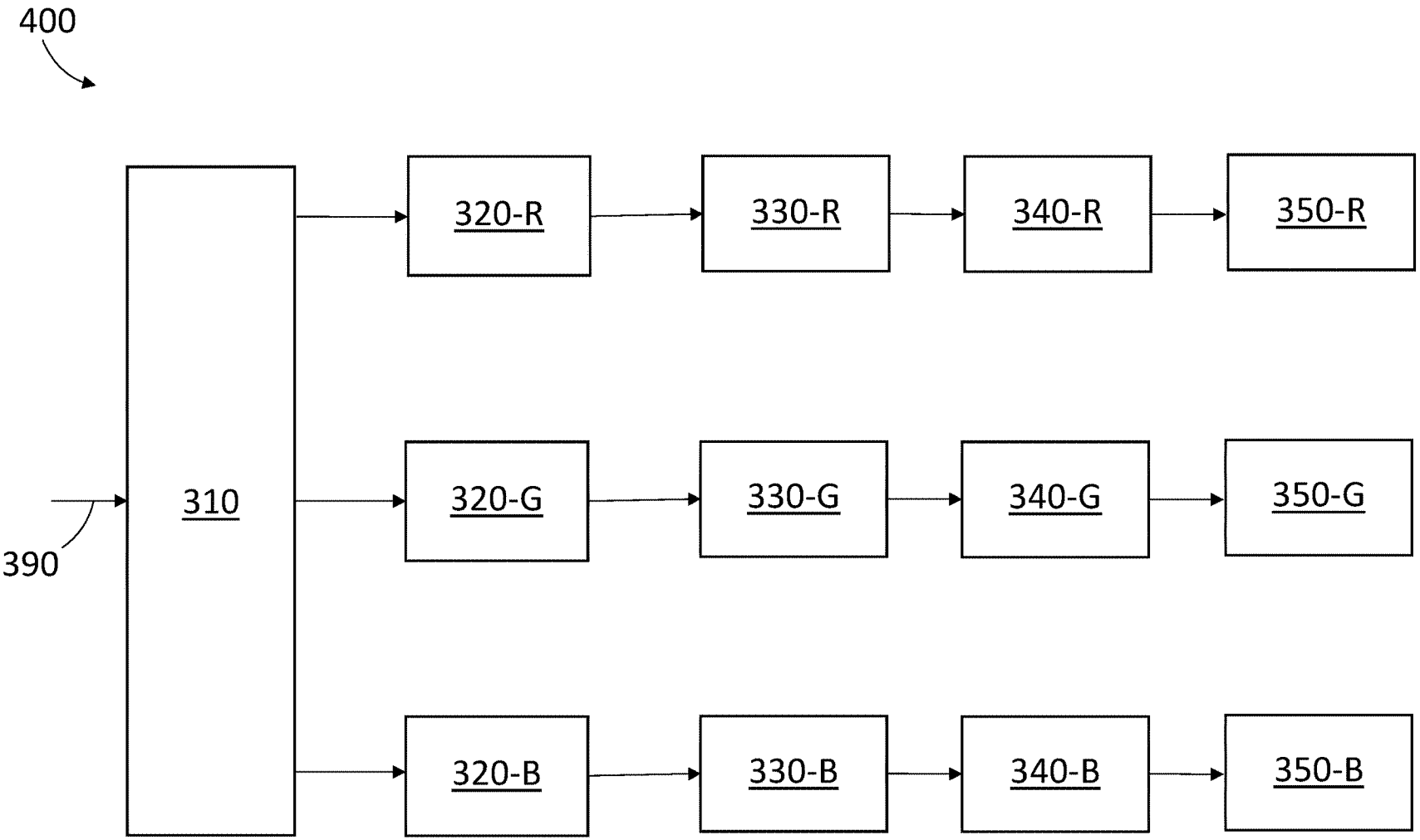
FIG. 4 is a schematic diagram of a display controller having separate color channels, in accordance with one or more embodiments.

FIG. 4 is a schematic view of an example display controller 400, which can be similar to display controller 300 discussed above. Description of components in FIG. 3 can be applicable to similarly numbered components in FIG. 4.

One difference between display controller 400 in FIG. 4 and display controller 300 in FIG. 3 is that FIG. 4 illustrates a separate compositor, P-operator, Q-operator, and LDD for each color channel. In particular, compositor 320-R, P-operator 330-R, Q-operator 340-R, and LDD 350-R can be similar to compositor 320, P-operator 330, Q-operator 340, and LDD 350, respectively, but are dedicated to a first color channel (e.g. red), and drive light sources corresponding to the first color channel (e.g., one or more red laser diodes). Similarly, compositor 320-G, P-operator 330-G, Q-operator 340-G, and LDD 350-G can be similar to compositor 320, P-operator 330, Q-operator 340, and LDD 350, respectively, but are dedicated to a second color channel (e.g. green), and drive light sources corresponding to the second color channel (e.g., one or more green laser diodes). Similarly, compositor 320-B, P-operator 330-B, Q-operator 340-B, and LDD 350-B can be similar to compositor 320, P-operator 330, Q-operator 340, and LDD 350, respectively, but are dedicated to a third color channel (e.g. blue), and drive light sources corresponding to the third color channel (e.g., one or more blue laser diodes). Although FIG. 4 illustrates three color channels, fewer or more color channels are possible. Further, color channels other than red, blue, and green are also possible.

FIG. 4 illustrates LDDs 350-R, 350-G, and 350-B as being included in display controller 400. However, it is also possible for LDDs 350-R, 350-G, and 350-B to be separate from display controller 400.

FIG. 4 illustrates a single framebuffer 310 from which image data is retrieved for each color channel by compositor 320-R, compositor 320-G, and compositor 320-B. In this example, input image data 390 can be image data which includes multiple color channels, and each of compositor 320-R, compositor 320-G, and compositor 320-B can extract image data from framebuffer 310 corresponding to the respective color channel. In some examples, image data may be stored in framebuffer 310, with each stored pixel having a value for each color channel in the pixel, and each compositor can retrieve the respective value for the appropriate color channel. In other examples, framebuffer 310 may store image data for each color channel separately, such that there is essentially a first block (or group of blocks) of image data representing a first color channel in an image, a second block (or group of blocks) of image data representing a second color channel in an image, a third block (or group of blocks) of image data representing a third color channel in an image. Each compositor may then retrieve image data from the appropriate block or group of blocks.

Even though FIG. 4 illustrates a single framebuffer 310 for storing image data to be retrieved by all of the compositors, it is possible for this single framebuffer to be partitioned to stored different image frames, such as for enabling self-refresh of display controller 400. Framebuffer management and self-refresh are described in detail in U.S. Provisional Patent Application No. 63/013,101.

In alternative embodiments, display controller 400 may include a separate framebuffer for each color channel.

Figure 5:
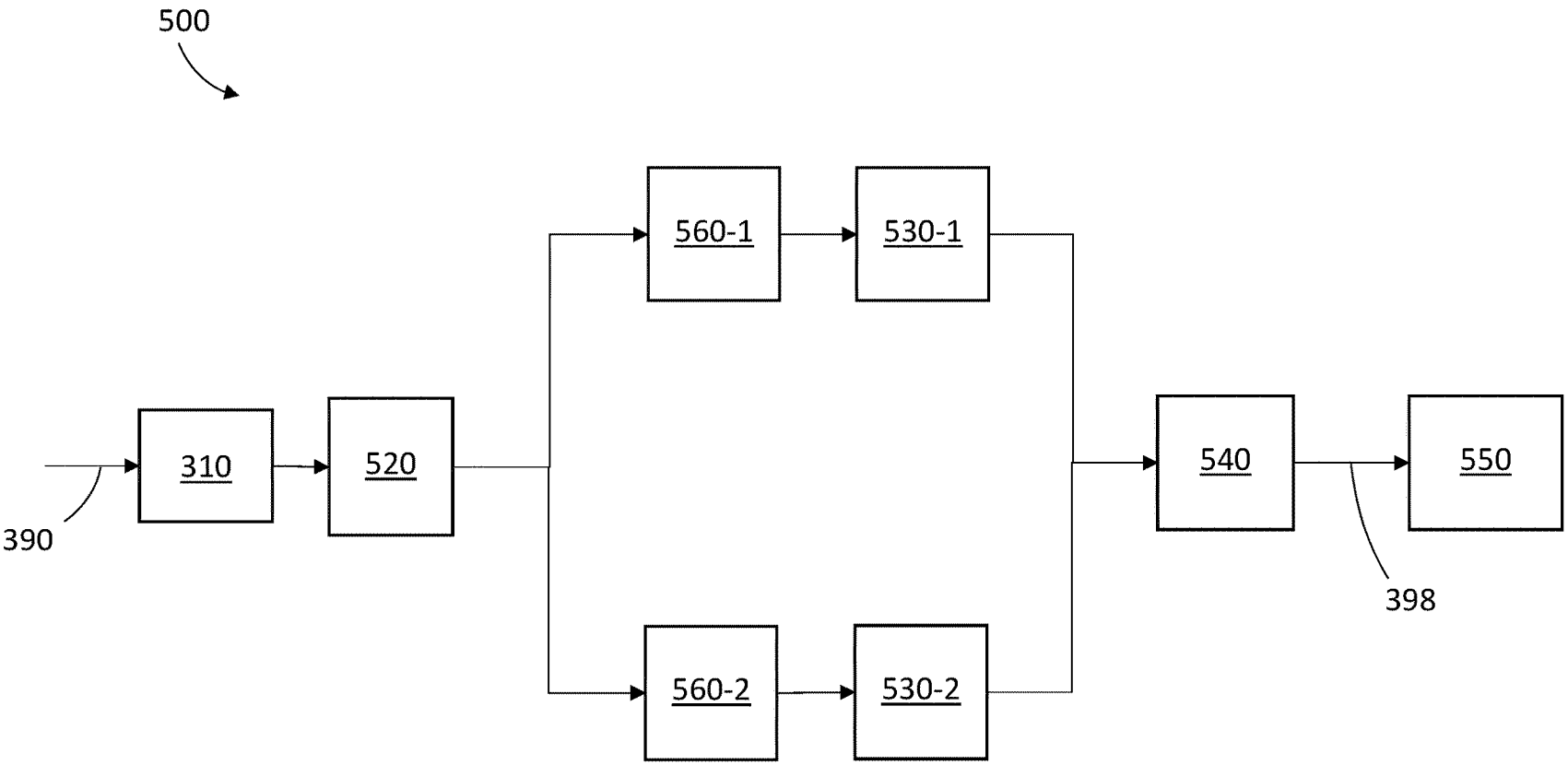
FIG. 5 is a schematic diagram of a display controller including odd and even P-operators, in accordance with one or more embodiments.

FIG. 5 is a schematic view of an example display controller 500, which can be similar to display controller 300 and display controller 400 discussed above. Description of components in FIG. 3 and FIG. 4 can be applicable to similarly numbered components in FIG. 5.

In some examples, display controller 500 can process image data for a plurality of color channels. In other examples, display controller 500 can process image data for a single color channel, such as in a monochromatic display. In some examples, display controller 500 as shown in FIG. 5 can be a portion of a greater display controller, where display controller 500 processes image data for a single color channel, and additional display controllers are included which process image data for other color channels, similar to as described with reference to FIG. 4.

In display controller 500 illustrated in FIG. 5, framebuffer 310, compositor 520, Q-operator 540, and LDD driver 550 can be similar to framebuffer 310, compositor 320, Q-operator 340, and LDD driver 350 described above with reference to FIGS. 3 and 4.

One difference between FIG. 5 and FIGS. 3 and 4 is that display controller 500 in FIG. 5 includes "odd" linebuffer 560-1 and "even" linebuffer 560-2, as well as "odd" P-operator 530-1 and "even" P-operator 530-2. Compositor 520 can retrieve (or selectively retrieve) one line of image data from framebuffer 310 at a time, and store each retrieved line of image data in either odd linebuffer 560-1 or even linebuffer 560-2 alternately. Odd P-operator 530-1 can retrieve image data from odd linebuffer 560-1, and even P-operator 530-2 can retrieve image data from even linebuffer 560-2. Similar to P-operator 330 discussed above, odd P-operator 530-1 and even P-operator 530-2 can perform intra-line operations on image data retrieved from the respective linebuffers, such as selectively retrieving only certain portions or pixels of image data, or rearranging pixel order of the image data (e.g. reading image data forwards or backwards to match a projection pattern for the line for a given frame).

Odd P-operator 530-1 can output first intermediate P-operated data, and even P-operator 530-2 can output second intermediate P-operated data. Such first intermediate P-operated data and second intermediate P-operated data can be provided to Q-operator 540. In this way, Q-operator can have access to two lines of intermediate P-operated image data, which enables faster inter-line operations, such as interpolation between lines.

Q-operator 540 can provide image data 398 to LDD driver 550, which can drive at least one laser diode according to image data 398. Image data 398 can be a stream of pixel data, similar to as described above.

Figure 6:
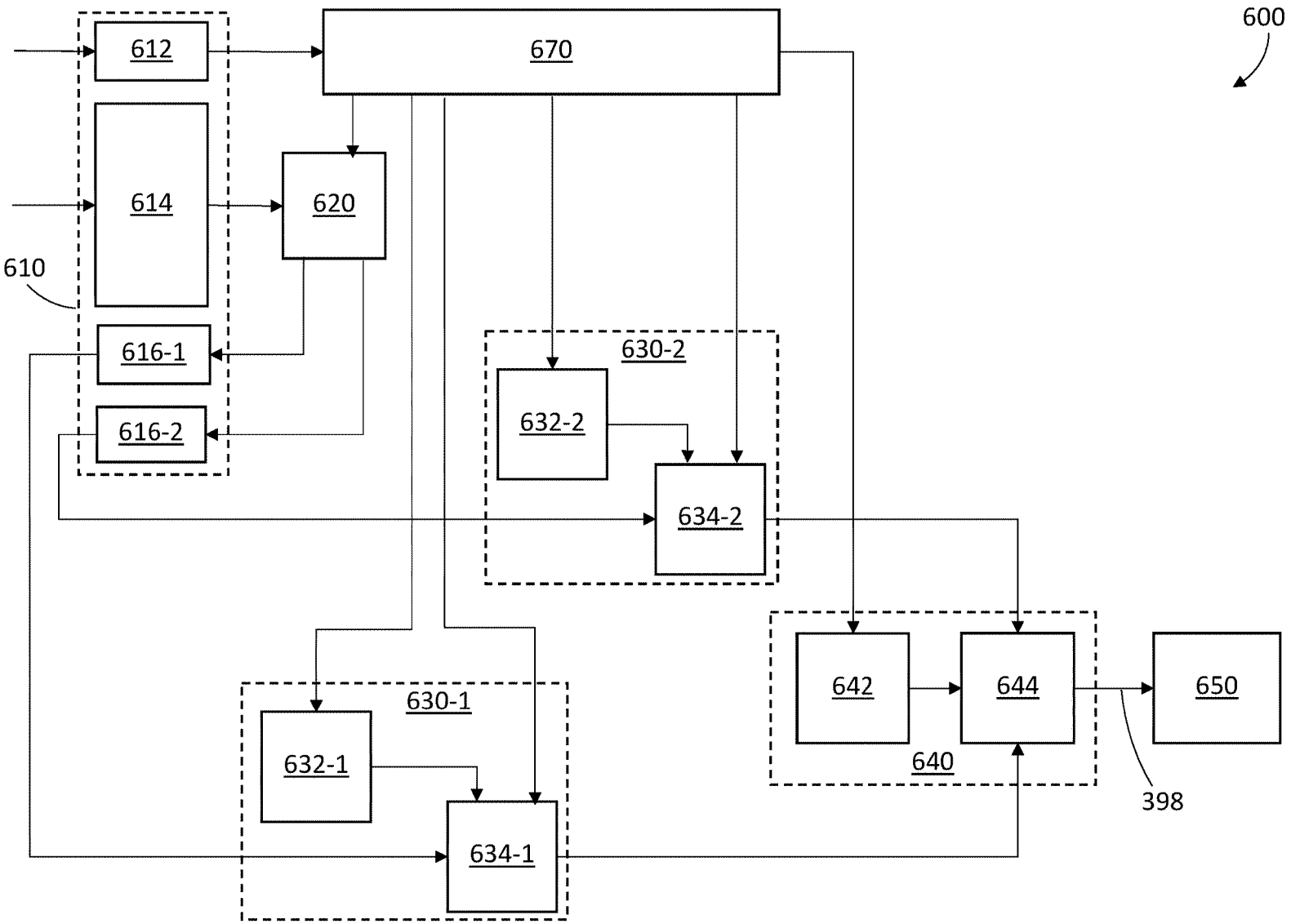
FIG. 6 is a schematic diagram of a display controller including odd and even P-operators and a memory controller, in accordance with one or more embodiments.

FIG. 6 is a schematic view of an example embodiment of a display controller 600, which may be similar to one or more of display controller 300, display controller 400, and display controller 500 discussed elsewhere herein. It will be appreciated that the description of components with respect to FIG. 3, FIG. 4, and FIG. 5 may be applicable to similarly numbered components in FIG. 6 unless context clearly indicates otherwise.

In certain embodiments, display controller 600 can process image data for a plurality of color channels. In other embodiments, display controller 600 can process image data for a single color channel, such as in a monochromatic display. In various scenarios and embodiments, display controller 600 as shown in FIG. 6 can be a portion of a greater display controller, where display controller 600 processes image data for a single color channel, and additional display controllers are included which process image data for other color channels, similar to as described with reference to FIG. 4.

FIG. 6 illustrates several non-limiting examples of display controller features which may be in included in any of the other display controllers discussed herein.

In the illustrated embodiment of FIG. 6, the display controller 600 includes a framebuffer 610, a compositor 620, odd P-operator 630-1, even P-operator 630-2, Q-operator 640, laser diode driver (LDD) 650, and memory controller 670. Framebuffer 610 can be similar to framebuffer 310 discussed above; compositor 620 can be similar to compositors 320 and 520 discussed above; odd and even P-operators 630-1 and 630-2 can be similar to P-operators 330, 530-1, and 530-2 discussed above; Q-operator 640 can be similar to Q-operators 340 and 540 discussed above; and LDD 650 can be similar to LDDs 350 and 550 discussed above.

In the depicted embodiment, framebuffer 610 is partitioned into several portions: instructions partition 612, image data partition 614, odd linebuffer 616-1, and even linebuffer 616-2. Odd linebuffer 616-1 can be similar to odd linebuffer 560-1 discussed above. Even linebuffer 616-2 can be similar to even linebuffer 560-2 discussed above. Instructions partition 612 can store processor-readable instructions that, when executed by a respective component in display controller 600, control operation of the component in accordance with the instructions. Such processor-readable instructions may be provided along with image data input to display controller 600, or may be provided separately. As non-limiting examples, such controller-readable instructions may include information pertaining to how input image data is organized arranged or compressed; a projection pattern of a scanning laser projection to be driven by display controller 600; and a compositor map of regions to be displayed (and/or a map of regions not to be displayed).

Memory controller 670 can be for example a microcontroller, microprocessor, multi-core processor, integrated-circuit, ASIC, FPGA, programmable logic device, processing circuitry, or any appropriate combination of these components. For example, display controller 600 may be an integrated circuit, and memory controller 670 may be a set of logical functions in the integrated circuit.

Memory controller 670 can control or arbitrate access to memory (the non-transitory processor readable medium which includes framebuffer 610). That is, memory controller 670 can provide memory access to components of display controller 600 as needed. Memory controller 670 may use for example a round robin or modified round robin priority scheme.

Compositor 620 can selectively retrieve a portion or portions of image data stored in image data partition 614 according to what image data is needed for display. For example, compositor 620 may retrieve image data according to regions where image data is to be displayed, eye tracking information, desired exit pupils, or any of the other examples discussed herein. Such information can be provided by a compositor map. Compositor 620 provides the retrieved portions of image data line-by-line alternately to odd linebuffer 616-1 and even linebuffer 616-2.

Odd P-operator 630-1 performs intra-line operations on image data from odd linebuffer 616-1. Even P-operator 630-2 performs intra-line operations on image data from even linebuffer 616-2. For example, odd P-operator 630-1 and even P-operator 630-2 may arrange image data for a line in an appropriate direction for display according to the projection pattern for a scanning laser projector, may compensate for non-linear mirror movement speed, and/or any other appropriate intra-line operations.

In the depicted embodiment of FIG. 6, odd P-operator 630-1 includes a P map generator 632-1 and a pixel extractor 634-1. Similarly, even P-operator 630-2 includes a P map generator 632-2 and a pixel extractor 634-2. Each of these P map generators can generate a P map which indicates what pixels should be retrieved from a respective linebuffer, in what order. In this sense, a P map can be a set of instructions that controls operation of a P-operator. The respective pixel extractor then extracts pixel data from the respective linebuffer based on the respective P map, and outputs extracted pixel data as a stream of pixels.

For example, each P map generator may generate a P map which compensates for non-linear movement speed of an oscillating scan mirror, by specifying repetition of pixels near peripheral regions of a line, as discussed later with reference to FIGS. 9 and 10A-10C. Based on such a P map, the respective pixel extractor may extract (retrieve) pixels from the respective linebuffer, extracting certain pixels multiple times where the P map indicates pixels should be repeated. The resulting P-operated data is output by the respective P-operator.

As another example, each P map generator may generate a P map which specifies a direction of pixels, either forwards or backwards, depending on the projection pattern of a scanning laser projector which will project the given line. Based on such a P map, the respective pixel extractor may extract (retrieve) pixels from the respective linebuffer, in the desired direction. The resulting P-operated data is output by the respective P-operator as a stream of pixels, which when projected by a scanning laser projector will appear correctly oriented in accordance with the projection pattern.

Q-operator 640 receives odd P-operated data output by P-operator 630-1 and even P-operated data output by P-operator 630-2, and can perform inter-line operations based on the received odd and even P-operated data. Q-operator 640 illustrated in FIG. 6 includes Q map generator 642 and operator 644. Q map generator 642 can generate a map of pixels to be operated on by operator 644. In this sense, a Q map can be a set of instructions that controls operation of a Q-operator. For example, Q map generator 642 may generate a Q map where certain pixels are to be interpolated between odd P-operated data and even P-operated data. For example, in systems which employ a scanning laser projector with an oscillating scan mirror, a projection pattern can have a zig-zag shape, as discussed in detail in U.S. Provisional Patent Application No. 62/863,935. Such a zig-zag shape can result in lines of an image not being parallel to each other, but odd P-operated data and even P-operated data may be generated for parallel lines of an image. This difference may be particularly prominent near peripheral regions of a projected image. Q-operator 640 can compensate for this, by Q map generator 642 generating a Q map where peripheral regions of the image data are to be interpolated between odd P-operated data and even P-operated data. Q-operator 640 can output interpolated image data to LDD 650. In this way, image data produced by Q-operator 640, when projected by a scanning laser projector, will more closely match the spatial position of pixels as output by the scanning laser projector.

LDD 650 can receive a stream of pixel data from Q-operator 650, and drive at least one laser diode according to the received stream of pixel data, such that when synchronized with movement of a scanning mirror, an image is projected.

Figure 7:
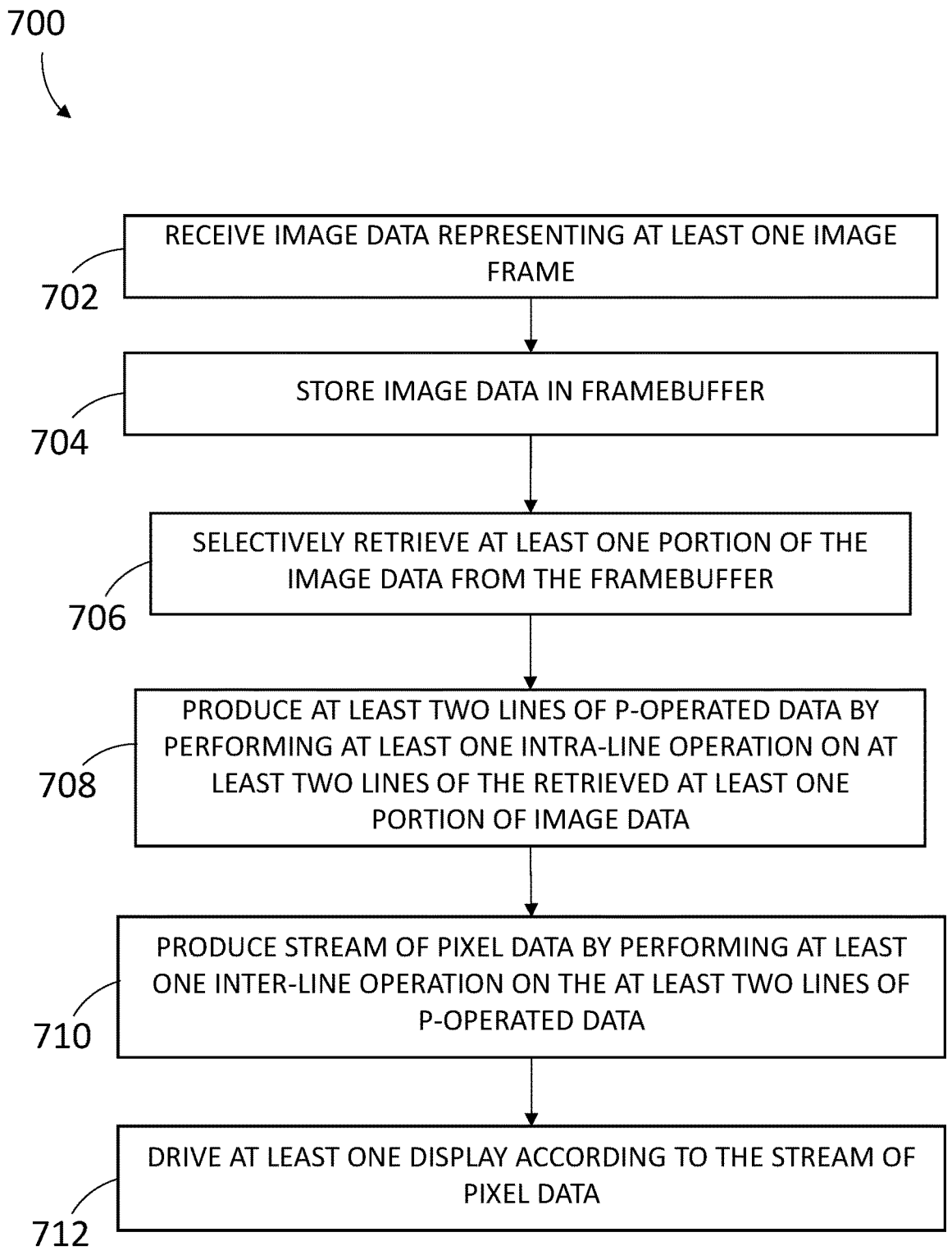
FIG. 7 is a flowchart diagram of a method of operating any of the display controllers described herein, in accordance with one or more embodiments.

FIG. 7 is a flowchart diagram which illustrates an example method 700 of operating any of the display controllers discussed herein. Discussion of method 700 below generally makes reference to components of display controller 300 in FIG. 3, but method 700 is fully applicable to display controller 400 in FIG. 4, display controller 500 in FIG. 5, and display controller 600 in FIG. 6. Method 700 in FIG. 7 is shown as including acts in boxes 702, 704, 706, 708, 710, and 712. However, the order of acts in method 700 may be rearranged, or acts may be removed or added, as appropriate for a given application.

In box 702, image data representing at least one image frame is received by a display controller (e.g. display controller 300). Such image data may be rendered and provided by a render engine such as render engine 110 discussed above. In box 704, the received image data is stored in a framebuffer of a non-transitory processor-readable medium (e.g. framebuffer 310), such as described above.

In box 706, at least one portion of the image data in the framebuffer is selectively retrieved by a compositor (e.g. compositor 320), such as is described above. The compositor can provide the at least one portion of the image data to at least one P-operator (e.g. P-operator 330). In some embodiments, the compositor can provide the at least one portion of the image data line-by-line to at least one linebuffer (e.g. linebuffers 560-1, 560-2, 616-1, or 616-2), and the at least one P-operator can retrieve the at least one portion of the image data from the at least one linebuffer.

In box 708, the at least one P-operator (e.g. P-operator 330) can perform at least one intra-line operation, such as those described above, on at least two lines of the retrieved at least one portion of image data to produce at least two lines of P-operated data. This may be repeated for additional lines of the retrieved at least one portion of image data, to produce additional lines of P-operated data. In some embodiments, at least two P-operators (e.g., P-operators 530-1 and 530-2, or P-operators 630-1 and 630-2) may perform intra-line operations on alternating lines of the retrieved at least one portion of image data, to produce the at least two lines of P-operated data. The at least two lines of P-operated data are provided to a Q-operator (e.g. Q-operator 340).

In box 710, the Q-operator performs at least one inter-line operation, such as those described above, on the at least two lines of P-operated data to produce a stream of pixel data.

In box 712, a display is driven according to the stream of pixel data. For example, in a system with a scanning laser projector-based display, at least one LDD (e.g. LDD 350, 550, or 650) can drive at least one respective laser diode to pulse laser light according to the processed stream of pixels. When synchronized with movement of at least one scanning mirror, the pulses of laser light can form a display.

As mentioned above, method 700 can include additional acts to those shown in FIG. 7. As one example, the image data received in box 702 may be compressed, and box 704 may include storing the compressed image data in the framebuffer. In box 706, retrieving at least one portion of the image data from the framebuffer may also include decompressing the image data, or an additional act of decompressing the data may be performed before or after box 706.

As another example, the image data received in box 702 may be uncompressed, and method 700 may include an additional act of compressing the image data between box 702 and box 704. Additional acts of decompressing the image data may also be included similar to as described above.

Figure 8:
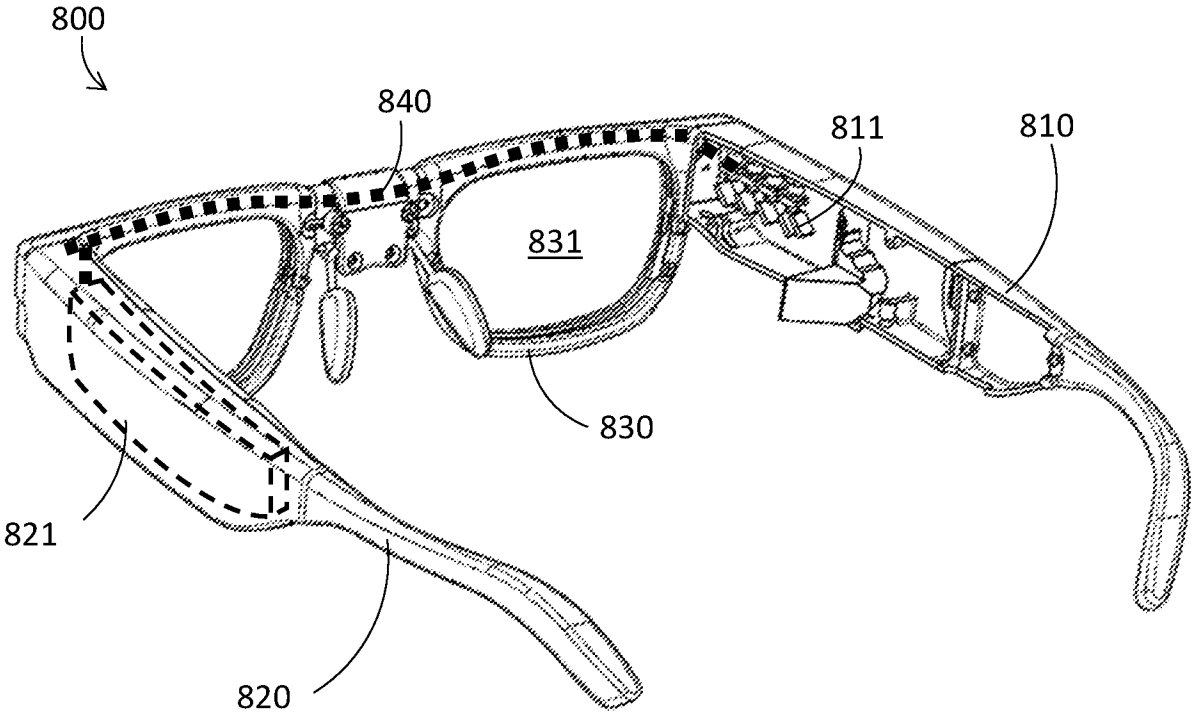
FIG. 8 is a partial-cutaway perspective diagram of a wearable device in accordance with one or more embodiments.

FIG. 8 is a partial-cutaway perspective diagram of an example wearable device 800 in which present systems, devices, and methods can be implemented. The wearable device 800 is a non-limiting example, and the present systems, devices, and methods can be implemented in many other types of portable or non-portable devices, including televisions, monitors, vehicular heads-up displays, smartwatches, smartphones, or any other appropriate device having a display.

Wearable device 800 includes a first arm 810, a second arm 820, and a front frame 830 which is physically coupled to first arm 810 and second arm 820. When worn by a user, first arm 810 is to be positioned on a first side of a head of the user, second arm 820 is to be positioned on a second side of a head of a user opposite the first side of the head of the user, and front frame 830 is to be positioned on a front side of the head of a user. First arm 810 can carry a light engine assembly 811 which outputs light representative of display content to be viewed by a user. First arm 810 may also carry several additional components of wearable device 800, such as at least one processor, at least one non-transitory processor-readable storage medium, a power supply circuit, render engine 110 discussed above, or display controllers 120, 300, 400, 500, or 600 discussed above, for example. A display controller in wearable device 800 can control operation of light engine assembly, in any of the manners discussed above. Front frame 830 carries an optical combiner 831 in a field of view of the user which receives light output from the light engine assembly 811 and redirects this light to form a display to be viewed by the user. Light engine assembly 811 and optical combiner 831 together can form a display, such as display 130 discussed above. In the case of FIG. 8, the display will be a monocular display visible to a right eye of a user. Second arm 820 as shown in FIG. 8 carries a power source 821 which powers the components of wearable device 800. Front frame 830 may also carry a camera. Front frame 830 also carries at least one set of electrically conductive current paths 840 which provide electrical coupling between power source 821 and light engine 811, and any other electrical components carried by first arm 810.

"Power source" as used herein can refer to a component which provides electrical power. This may include for example a source of stored power such as a battery, including a chemical battery or a mechanical battery, or may include power generation systems such as piezoelectric elements, solar cells, or similar. A "set of electrically conductive current paths" as used herein can refer to a single electrically conductive current path, such as a wire or conductive trace on a printed circuit board, as well as a plurality of electrically conductive current paths, such as a plurality of wires or a plurality of conductive traces on a printed circuit board.

Detailed embodiments of how such a monocular arrangement can be implemented are discussed in for example U.S. Provisional Patent Application No. 62/862,355. However, such an arrangement is merely a non-limiting example. As another non-limiting example, the orientation of wearable device 800 may be reversed, such that the display is presented to a left eye of a user instead of the right eye. As another example, second arm 820 may carry a light engine assembly similar to light engine assembly 811 carried by first arm 810, and front frame 830 may also carry another optical combiner similar to optical combiner 831, such that wearable device 800 presents a binocular display to both a right eye and a left eye of a user.

Further, beyond reversing the orientation of wearable device 800, the arm in which components are carried in wearable device 800 may be changed or rearranged as appropriate to balance or optimally position components of wearable device 800.

Light engine assembly 811 and optical combiner 831 can include any appropriate display architecture for outputting light and redirecting the light to form a display to be viewed by a user. For example, light engine 811, and any of the light engines discussed herein, may include at least one component selected from a group including at least one of a projector, a scanning laser projector, a microdisplay, a white-light source, or any other display technology as appropriate for a given application. Optical combiner 831, and any of the optical combiners discussed herein, may include at least one optical component selected from a group including at least: a waveguide, at least one holographic optical element, at least one prism, a diffraction grating, at least one light reflector, a light reflector array, at least one light refractor, a light refractor array, or any other light-redirection technology as appropriate for a given application, positioned and oriented to redirect the display light towards the eye of the user. Optical combiner 831 can be carried by a lens, and the lens can be carried by front frame 830. For example, optical combiner 831 may be: a layer formed as part of a lens, a layer adhered to a lens, a layer embedded within a lens, a layer sandwiched between at least two lenses, or any other appropriate arrangement. A layer can for example be molded or cast, and/or may include a thin film and/or coating. Alternatively, optical combiner 831 may be a lens carried by front frame 830. Further, a "lens" as used herein can refer to a plano lens which applies no optical power and does not correct a user's vision, or a "lens" can be a prescription lens which applies an optical power to incoming light to correct a user's vision.

Example display architectures may include, for example, scanning laser projector and holographic optical element combinations, side-illuminated optical waveguide displays, pin-light displays, or any other wearable heads-up display technology as appropriate for a given application. Example display architectures are described in at least U.S. patent application Ser. No. 16/025,820, U.S. patent application Ser. No. 15/145,576, U.S. patent application Ser. No. 15/807,856, U.S. Provisional Patent Application No. 62/754,339, U.S. Provisional Patent Application Ser. No. 62/782,918, U.S. Provisional Patent Application Ser. No. 62/789,908, U.S. Provisional Patent Application Ser. No. 62/845,956, and U.S. Provisional Patent Application Ser. No. 62/791,514.

The term "light engine" as used herein is not limited to referring to a singular light source, but can also refer to a plurality of light sources, and can also refer to a "light engine assembly". A light engine assembly may include some components which enable the light engine to function, or which improve operation of the light engine. As one example, a light engine assembly may include at least one light source, such as a laser or a plurality of lasers. The light engine assembly may additionally include electrical components such as driver circuitry to power the at least one light source. The light engine assembly may additionally include optical components such as collimation lenses, a beam combiner, or beam shaping optics. The light engine assembly may additionally include beam redirection optics such as least one MEMS mirror, which can be operated to scan light from at least one laser light source such as in a scanning laser projector. In the above example, the light engine assembly includes not only a light source, but also components which take the output from at least one light source and produce conditioned display light. All of the components in the light engine assembly can be included in a housing of the light engine assembly, may be affixed to a substrate of the light engine assembly such as a printed circuit board or similar, or may be separately mounted components of a wearable device.

The term "optical combiner" as used herein can also refer to an "optical combiner assembly". An optical combiner assembly may include additional components which support or enable functionality of the optical combiner. As one example, a waveguide combiner may be very thin, and consequently very fragile. To this end, it may be desirable to position the waveguide combiner within or on a transparent carrier, such as a lens. An optical combiner assembly may be a package which includes the transparent carrier and the waveguide positioned therein or thereon. As another example, an optical combiner assembly may include a prescription component, which applies an optical power to incoming light to compensate for imperfect user eyesight. Such a prescription component may include curvature applied to a transparent carrier itself, or may include a component additional to the transparent carrier, such as a clip-in or add-on lens.

In some examples, a wearable device, such as wearable device 800 illustrated in FIG. 8, may be communicatively coupled to a peripheral device, such as a smartphone, PDA, digital assistant, tablet, or similar. As another example, a peripheral device may be a purpose-built processing pack designed to be paired with wearable device 800. The peripheral device can include at least one processor. Further, the peripheral device may include long-range wireless communication hardware, such as hardware which enables 2G, 3G, 4G, 5G, LTE, or other forms of wireless communication. The peripheral device may also include short-range wireless communication hardware, such as hardware which enables Bluetooth®, ZigBee®, WiFi®, or other forms of wireless communication.

Wearable device 800 can be communicatively coupled to a peripheral device, which may be wireless or wired communication. One non-limiting use for a peripheral device may include off-loading at least some processing burden from wearable device 800 to the peripheral device. In this way, power consumption by wearable device 800 may be reduced, thereby enabling a smaller battery and/or longer battery life for wearable device 800. Further, at least one processor carried by wearable device 800 may be reduced in size, or eliminated entirely. For example, render engine 110 may be on a peripheral device, with display controller 120 and display 130 being on wearable device 800.

FIGS. 9 and 10A-10C discussed below pertain to compensating for non-linear movement speed of an oscillating MEMS mirror in a scanning laser projector-based system.

Figure 9:
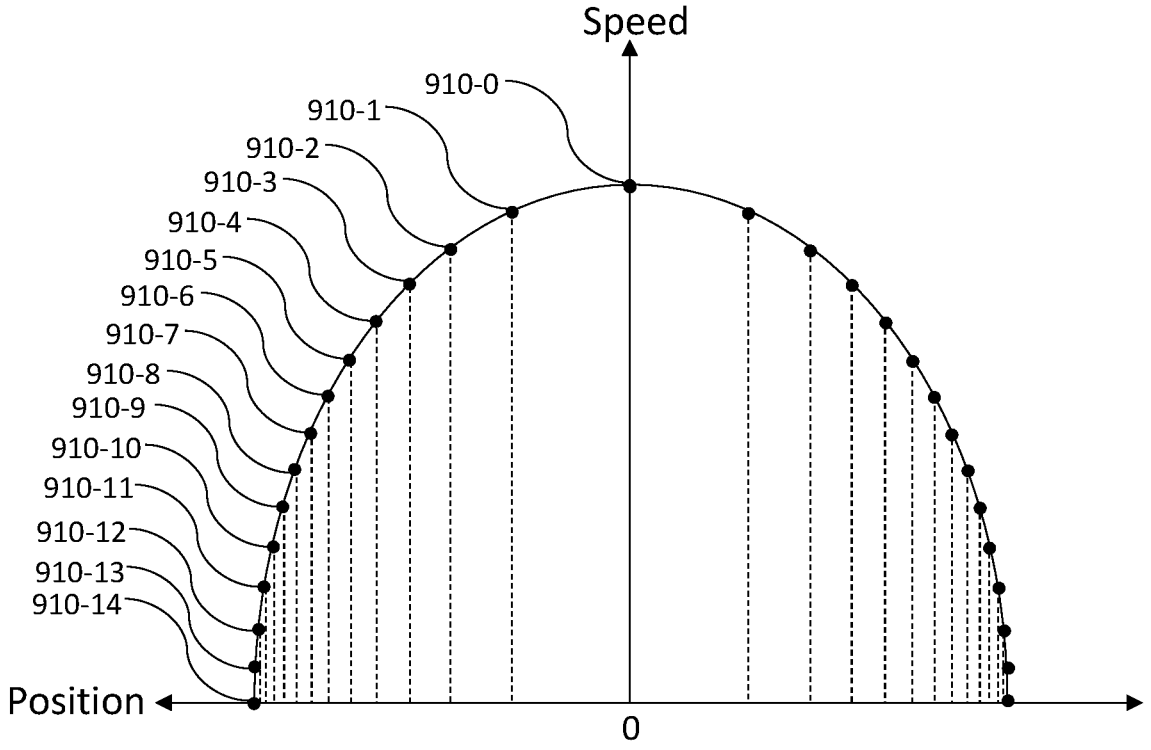
FIG. 9 is a plot diagram which illustrates position versus speed of an oscillating scan mirror in a scanning laser projector-based system.

FIG. 9 is a plot diagram which illustrates position versus speed of an oscillating scan mirror in a scanning laser projector-based system. In particular, some scanning laser projectors include two or more scan mirrors (such as MEMS-based mirrors) which move in non-parallel directions (e.g. orthogonal). Laser light from at least one laser-light source is scanned by one scan mirror along a first direction, onto another scan mirror, which in turn scans the laser light along a second direction non-parallel to the first direction. In this way, the at least two scan mirrors can scan the laser light over an area. By pulsing the at least one laser-light source according to a sequence of pixel data, a display can be formed.

In such embodiments, one or more of the scan mirrors can be driven to oscillate, i.e. scan back and forth. However, the movement speed of such an oscillating mirror is typically not linear. For example, if the oscillating scan mirror is driven by a sinusoidal signal, or by oscillating electrostatic pulses and torsional strength of a support bar of the mirror, the movement speed of the scan mirror will be sinusoidal or parabolic. If the at least one laser light source is pulsed at regular intervals, positioning of pixels in the resulting display will not be even. This is illustrated in FIG. 9, which shows position versus speed for an oscillating scan mirror, over the scan range of the mirror for one line. In particular, the mirror will have the highest speed at the center position of the movement range ("0" in FIG. 9), and will slow down as the mirror swings away from the center position. The speed of the mirror will eventually reach 0 at the edge of the opening angle of the mirror (i.e. when the mirror reaches the maximum desired deflection angle from the center position, which can be determined and/or controlled based on the needs of a given display). The mirror will then reverse direction and begin to accelerate back towards the center position, reaching peak speed as the mirror passes the center position, slowing down as the mirror moves from the center position towards the opposite edge of the opening angle, where the mirror will reach a speed of 0, and movement direction will again reverse.

FIG. 9 shows points 910, including points 910-0, 910-1, 910-2, 910-3, 910-4, 910-5, 910-6, 910-7, 910-8, 910-9, 910-10, 910-11, 910-12, 910-13, and 910-14. Only the points of the left side of FIG. 9 are labelled with reference numerals, but the description pertaining to these points is fully applicable to the points on the right side of FIG. 9. Each point 910 in FIG. 9 corresponds to a pulse of laser light, and thus corresponds to a projected pixel. FIG. 9 illustrates a total of 29 points (including labelled and unlabeled points), which represents 29 pixels across (i.e. 29 pixels in one line). This quantity of pixels is merely a non-limiting example—in practice, fewer or more pixels may be projected in any given line, according to the needs of the display. In many cases, far more pixels can be projected in one line, to enable high resolution displays, such as 720p, 1080p, 2 k, 4 k, and others.

FIG. 9 illustrates a case where the at least one laser light source is driven to pulse pixels periodically; that is, at a constant frequency. However, due to the non-linear movement speed of the oscillating mirror, the projected pixels will not be evenly spaced as can be seen in FIG. 9. As examples, points 912-12, 910-13, and 910-14 significantly overlap near the periphery of the line, due to the slow movement speed of the scan mirror near the periphery. On the other hand, points 910-0, 910-1, and 910-2 are spaced far apart nearer to the center position 0, where the mirror movement speed is higher. Example embodiments to compensate for this non-even pixel spacing are discussed below with reference to FIGS. 10A-10C.

Figure 10A:
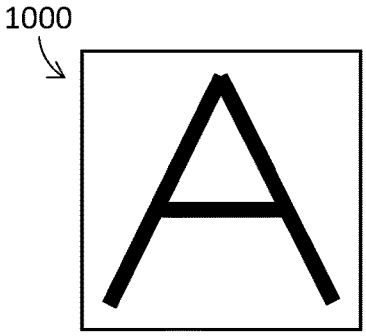
FIG. 10A illustrates an image 1000 to be projected.

FIG. 10A illustrates an example desired image 1000 to be projected, featuring a properly formed letter "A".

Figure 10B:
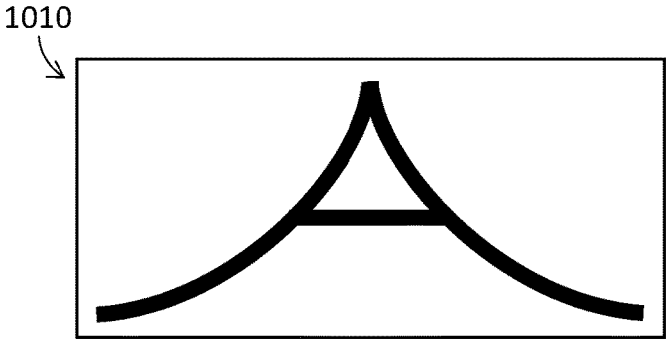
FIG. 10B illustrates example image data which may be used to project the desired image of FIG. 10A.

FIG. 10B illustrates example image data 1010 which may be used to project the desired image 1000. The image data 1010 as shown is intended for projection by a scanning laser projector with an oscillating horizontal scan mirror, and a linearly-controlled vertical scan mirror. That is, the vertical scan mirror can be controlled by another drive scheme such as a scan-retrace scheme or a triangular scheme, where movement speed of the vertical mirror is controlled and is linear throughout motion thereof. As a result, the example image data 1010 only compensates for non-linear movement speed in the horizontal direction. However, in other embodiments, the oscillating scan mirror may scan along a different direction (such as vertical) such that compensation for non-linear movement speed is applied in a different direction. In yet other embodiments, both scan mirrors may oscillate with non-linear movement speed, and compensation for such non-linear movement may be applied along both scan directions.

In the example of FIG. 10B, in order to project the desired image 1000, the frequency at which the at least one laser light source is pulsed may be set to a frequency which results in a desired resolution near center position of the movement path of the oscillating mirror, where movement speed is fastest. Because of the slower movement speed of the oscillating mirror away from the center position, additional pixels can be provided away from the center position. In this way, even though the scan mirror has a lower movement speed away from the center position, the desired image 1000 can still be projected without spatial distortion, essentially by projecting additional pixels in regions away from the center region. FIG. 10B illustrates image data 1010, with each pixel of data being evenly spaced, resulting in the horizontally stretched appearance in FIG. 10B. However, when projected by a scanning laser projector including an oscillating horizontal scan mirror, pixels near to the center position will be projected less densely than pixels away from the center position, such that the image data will be projected with an appearance like that of desired image 1000 in FIG. 10A.

However, image data 1010 can become excessively large, for minimal benefit. In particular, if pixels displayed near the center position have acceptable or desirable resolution, having additional image data (higher resolution image data) in peripheral regions of the image will be beyond acceptable or desirable. Further, in many cases, it is desirable for central regions of a display to have higher resolution than peripheral regions of the display, which is the opposite of image data 1010. In light of this, the additional pixels (higher resolution data) away from the center position in image data 1010 can be unnecessary, superfluous, or even imperceptible. However, additional processing and power resources are utilized to render the additional pixels in image data 1010, and additional memory is utilized to store the additional pixels in image data 1010, with minimal or imperceptible improvements in display quality. Thus, it is desirable to minimize the amount of additional pixels utilized to compensate for non-linear movement speed of oscillating scan mirrors.

Figure 10C:
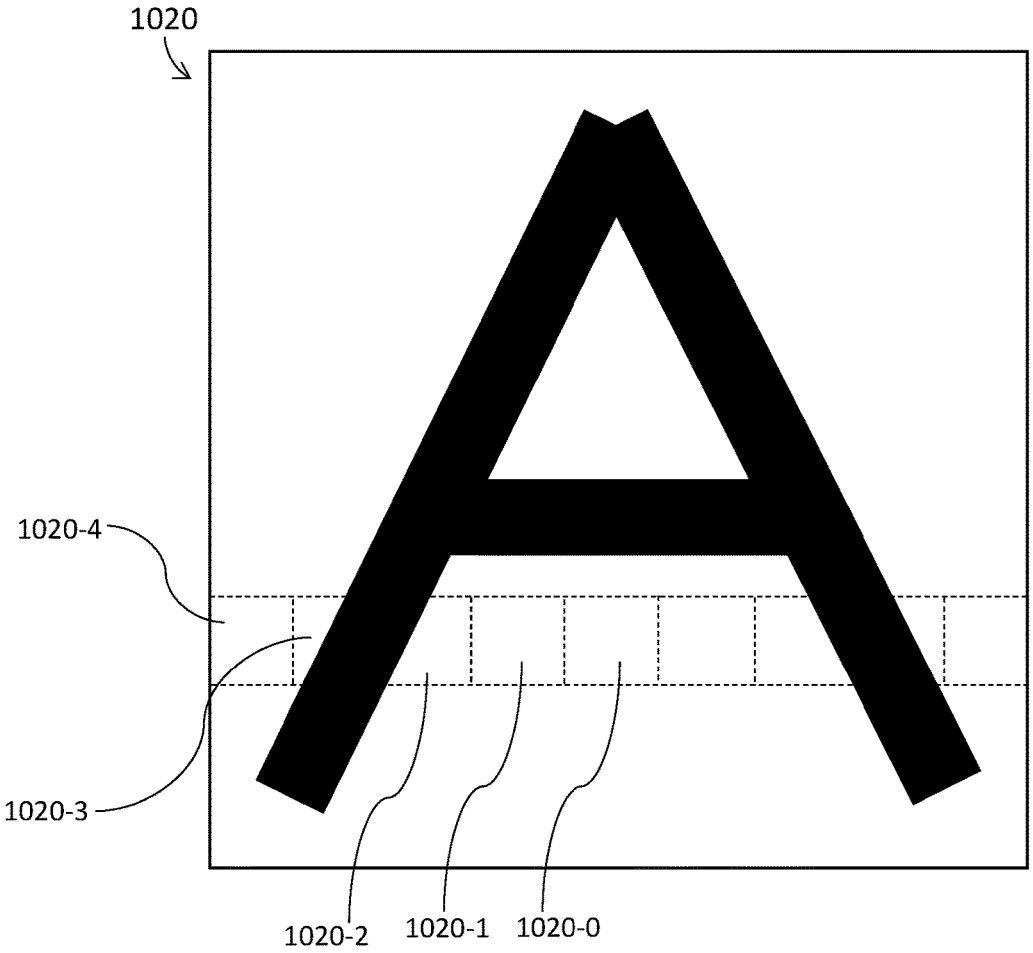
FIG. 10C illustrates image data in which repetition of pixels may be used to project the desired image of FIG. 10A.

FIG. 10C illustrates image data 1020, which does not include additional pixels like that shown in FIG. 10B. Instead, when projecting a line of image data 1020, certain pixels away from the center position can be repeated, such that periodic pulsing of the at least one laser light source can still result in display of the desired image 1000. For example, pixel 1020-4 may be repeated seven times, such that pixel 1020-4 is projected at each of points 910-14, 910-13, 910-12, 910-11, 910-10, 910-9, 914-8. Pixel 1020-3 may be repeated three times, such that pixel 1020-3 is projected at each of points 910-7, 910-6, and 910-5. Pixel 1020-2 may be repeated two times, such that pixel 1020-2 is projected at each of points 910-4 and 910-3. Pixel 1020-1 may be repeated two times, such that pixel 1020-1 is projected at each of points 910-2 and 910-1. Pixel 1020-0 may be projected only one time at point 910-0. As can be seen from this example, pixels which are nearer to the periphery of the image are repeated more times than pixels which are closer to the center position of the image. By repeating certain pixels in this manner, periodic pulsing of the at least one laser light source can still result in display of the desired image 1000. Compared to the image data 1010 in FIG. 10B, image data 1020 can be extrapolated to fill in the "additional pixels", without requiring rendering or storing of additional image data.

The exact number of times certain pixels are repeated described above are merely examples, and the appropriate repetition pattern may be determined as needed for a given embodiment. Further, only the pixels of the left side of FIG. 10C are labelled with reference numerals, but the description pertaining to these pixels is fully applicable to the pixels on the right side of FIG. 10C.

Repeating pixels of image data may be performed by any of the display controllers herein. In particular, any of the P-operators described herein may extract a given pixel from input image data (e.g., data from a compositor or data stored in a linebuffer) multiple times, such that a stream of image data output by the P-operator includes multiple copies of the given pixel. In this way, any of the LDDs described herein may be timed to a periodic clock (i.e., have a constant pulse frequency), and the LDD can drive at least one laser light source according to data from the P-operator (via a Q-operator), such that the LDD need not even be aware of the repetition of data. This embodiment also prevents additional image data from being rendered, stored in a framebuffer, retrieved by a compositor, and stored in a linebuffer.

In some embodiments, one or more optical fiber(s) may be used to guide light signals along some of the paths illustrated herein.

The wearable devices described herein may include one or more sensor(s) (e.g., microphone, camera, thermometer, compass, altimeter, and/or others) for collecting data from the user's environment. For example, one or more camera(s) may be used to provide feedback to the processor of the WHUD and influence where on the display(s) any given image should be displayed.

The wearable devices described herein may include one or more on-board power sources (e.g., one or more batteries)), a wireless transceiver for sending/receiving wireless communications, and/or a tethered connector port for coupling to a computer and/or charging the one or more on-board power source(s).

The wearable devices described herein may receive and respond to commands from the user in one or more of a variety of ways, including without limitation: voice commands through a microphone; touch commands through buttons, switches, or a touch sensitive surface; and/or gesture-based commands through gesture detection systems as described in, for example, U.S. Non-Provisional patent application Ser. No. 14/155,087, U.S. Non-Provisional patent application Ser. No. 14/155,107, PCT Patent Application PCT/US2014/057029, and/or U.S. Provisional Patent Application Ser. No. 62/236,060.

Generally herein, unless context dictates otherwise, reading and writing from memory, such as framebuffers, can be performed by the component which includes the framebuffer. For example, display controller 120 can write data to and read data from framebuffer 122. As another example, rendering engine 110 can write data to and read data from framebuffer 112. Further, in certain embodiments, it can be possible for some components to read data from memory of other components. For example, display controller 120 may be able to read data directly from framebuffer 112. Further, terminology where a component stores data in a framebuffer refers to the component writing data to the framebuffer, though it is the framebuffer itself which actually holds the data in store. For example, "a display controller stores data in a framebuffer" can refer to the display controller writing the data into the framebuffer, but it is the framebuffer which holds and stores the data.

Throughout this specification and the appended claims the term "communicative" as in "communicative pathway," "communicative coupling," and in variants such as "communicatively coupled," is generally used to refer to any engineered arrangement for transferring and/or exchanging information. Example communicative pathways include, but are not limited to, electrically conductive pathways (e.g., electrically conductive wires, electrically conductive traces), magnetic pathways (e.g., magnetic media), and/or optical pathways (e.g., optical fiber), and example communicative couplings include, but are not limited to, electrical couplings, magnetic couplings, and/or optical couplings.

Throughout this specification and the appended claims, infinitive verb forms are often used. Examples include, without limitation: "to detect," "to provide," "to transmit," "to communicate," "to process," "to route," and the like. Unless the specific context requires otherwise, such infinitive verb forms are used in an open, inclusive sense, that is as "to, at least, detect," to, at least, provide," "to, at least, transmit," and so on.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to other portable and/or wearable electronic devices, not necessarily the example wearable electronic devices generally described above.

For instance, the foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof.

The various embodiments described above can be combined to provide further embodiments. To the extent that they are not inconsistent with the specific teachings and definitions herein, each of the following are incorporated by reference herein in their entirety: in U.S. Provisional Patent Application No. 63/013,101, U.S. Provisional Patent Application No. 62/863,935, U.S. Provisional Patent Application No. 62/862,355, U.S. patent application Ser. No. 16/025,820, U.S. patent application Ser. No. 15/145,576, U.S. patent application Ser. No. 15/807,856, U.S. Provisional Patent Application No. 62/754,339, U.S. Provisional Patent Application Ser. No. 62/782,918, U.S. Provisional Patent Application Ser. No. 62/789,908, U.S. Provisional Patent Application Ser. No. 62/845,956, U.S. Provisional Patent Application Ser. No. 62/791,514, U.S. Provisional Patent Application No. 62/890,269, U.S. Non-Provisional patent application Ser. No. 14/155,087, U.S. Non-Provisional patent application Ser. No. 14/155,107, PCT Patent Application PCT/US2014/057029, and/or U.S. Provisional Patent Application Ser. No. 62/236,060. Aspects of the embodiments can be modified, if necessary, to employ systems, circuits and concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display controller comprising:

a framebuffer to store image data;

a compositor to selectively retrieve at least one portion of image data from the framebuffer, wherein each selectively retrieved portion of the at least one portion of image data corresponds to a contiguous subregion of the image data;

a first P-operator to receive the at least one portion of image data, and to produce intermediate data by performing at least one intra-line operation on the at least one portion of image data; and a Q-operator to receive the intermediate data, and to produce a stream of pixel data for driving a display by performing at least one inter-line operation on the intermediate data.

2. The display controller of claim 1, further comprising a second P-operator, a first linebuffer, and a second linebuffer, wherein:

the at least one portion of image data comprises a first line of image data and a second line of image data;

the first linebuffer is to receive and store the first line of image data;

the second linebuffer is to receive and store the second line of image data;

the first P-operator is to produce first intermediate data by performing at least one intra-line operation on the first line of image data;

the second P-operator is to produce second intermediate data by performing at least one intra-line operation on the second line of image data; and the Q-operator is to produce the stream of pixel data for driving the display by performing the at least one inter-line operation on the first intermediate data and the second intermediate data.

3. The display controller of claim 1, wherein the at least one intra-line operation performed by the first P-operator includes selecting one portion of image data of the selectively retrieved at least one portion of image data for inclusion in the intermediate data.

4. The display controller of claim 1, wherein the at least one intra-line operation performed by the first P-operator includes repeating selected pixels of the image data in the intermediate data.

5. The display controller of claim 1, wherein the at least one intra-line operation performed by the first P-operator includes selectively reordering pixels of the image data in the intermediate data.

6. The display controller of claim 1, wherein the at least one inter-line operation performed by the Q-operator includes selecting a limited portion of the intermediate data for inclusion in the stream of pixel data for driving the display, and wherein the limited portion of the intermediate data corresponds to one portion of image data of the selectively retrieved at least one portion of image data.

7. The display controller of claim 1, wherein the at least one inter-line operation performed by the Q-operator includes interpolating between at least two lines of the intermediate data.

8. The display controller of claim 1, further comprising a laser diode driver to drive at least one laser diode according to the stream of pixel data.

9. The display controller of claim 1 wherein the display controller comprises an integrated circuit, and the compositor, P-operator, and Q-operator are logical components of the integrated circuit.

10. The display controller of claim 1 further comprising a non-transitory processor-readable storage medium having instructions recorded thereon that, when executed, control operation of the compositor, first P-operator, and Q-operator.

11. A method of controlling a display by a display controller, the method comprising:

producing intermediate data by performing, by a first P-operator, at least one intra-line operation on at least one portion of image data selectively retrieved from a framebuffer, each selectively retrieved portion of the at least one portion of image data corresponding to a contiguous subregion of the image data;

receiving, by a Q-operator, the intermediate data; and producing a stream of pixel data for driving the display by performing, by the Q-operator, at least one inter-line operation on the intermediate data.

12. The method of claim 11, wherein selectively retrieving the at least one portion of image data from the framebuffer comprises:

selectively retrieving, by a compositor, a first line of image data from the framebuffer, and storing the first line of image data in a first linebuffer; and selectively retrieving, by the compositor, a second line of image data from the framebuffer, and storing the first line of image data in a second linebuffer;

the method further comprising:

retrieving, by the first P-operator, the first line of image data from the first linebuffer;

retrieving, by a second P-operator, the second line of image data from the second linebuffer; and producing second intermediate data by performing, by the second P-operator, at least one intra-line operation on the second line of image data, wherein:

producing intermediate data comprises producing first intermediate data by performing, by the first P-operator, at least one intra-line operation on the first line of image data; and producing a stream of pixel data for driving the display comprises performing, by the Q-operator, at least one inter-line operation on the first intermediate data and the second intermediate data.

13. The method of claim 11, wherein performing the at least one intra-line operation by the first P-operator includes selecting one portion of image data of the selectively retrieved at least one portion of image data for inclusion in the intermediate data.

14. The method of claim 11, wherein performing the at least one intra-line operation by the first P-operator includes repeating selected pixels of the image data in the intermediate data.

15. The method of claim 11, wherein performing the at least one intra-line operation by the first P-operator includes selectively reordering pixels of the image data in the intermediate data.

16. The method of claim 11, wherein performing the at least one inter-line operation by the Q-operator includes selecting a limited portion of the intermediate data for inclusion in the stream of pixel data for driving the display, the limited portion of the intermediate data corresponding to one portion of image data of the selectively retrieved at least one portion of image data.

17. The method of claim 11, wherein performing the at least one inter-line operation by the Q-operator includes interpolating between at least two lines of the intermediate data.

18. The method of claim 11, further comprising:

receiving the stream of pixel data by a laser diode driver; and driving, by the laser diode driver, at least one laser diode according to the stream of pixel data.

19. A wearable heads-up display (WHUD) comprising:

a support structure to be worn on head of a user;

a display carried by the support structure;

a render engine carried by the support structure, the render engine to render image data for display; and a display controller, the display controller including:

a framebuffer to receive and store image data from the render engine;

a compositor to selectively retrieve at least one portion of image data from the framebuffer, wherein each selectively retrieved portion of the at least one portion of image data corresponds to a contiguous subregion of the image data;

a first P-operator to receive the at least one portion of image data, and to produce intermediate data by performing at least one intra-line operation on the at least one portion of image data; and a Q-operator to receive the intermediate data, and to produce a stream of pixel data by performing at least one inter-line operation on the intermediate data, the display to be driven according to the stream of pixel data.

20. The WHUD of claim 19, wherein:

the display controller further comprises a second P-operator, a first linebuffer, and a second linebuffer;

the first linebuffer is to receive and store the first line of image data;

the compositor is to selectively retrieve a second line of image data from the framebuffer;

the second linebuffer is to receive and store the second line of image data;

the first P-operator is to retrieve the first line of image data from the first linebuffer, and to produce first intermediate data by performing at least one intra-line operation on the first line of image data;

the second P-operator is to retrieve the second line of image data from the second linebuffer, and to produce second intermediate data by performing at least one intra-line operation on the second line of image data; and the Q-operator is to receive the first intermediate data and the second intermediate data, and to produce the stream of pixel data by performing at least one inter-line operation on the first intermediate data and the second intermediate data.

* * * * *